US008710763B2

(12) United States Patent
Hakkarainen et al.

(10) Patent No.: US 8,710,763 B2
(45) Date of Patent: Apr. 29, 2014

(54) METHOD AND APPARATUS FOR CONVERTING AN ELECTRONIC SWITCH TO A DIMMER SWITCH

(75) Inventors: Susan Hakkarainen, Doylestown, PA (US); Joseph M. Nichols, Jr., Boyertown, PA (US); Michael W. Pessina, Allentown, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 652 days.

(21) Appl. No.: 12/962,748

(22) Filed: Dec. 8, 2010

(65) Prior Publication Data

US 2011/0140548 A1 Jun. 16, 2011

Related U.S. Application Data

(60) Provisional application No. 61/267,483, filed on Dec. 8, 2009.

(51) Int. Cl.
*H05B 37/02* (2006.01)

(52) U.S. Cl.
USPC ..... 315/292; 315/291; 315/307

(58) Field of Classification Search
USPC ..... 200/237, 333, 43.22; 315/362; 174/488, 174/481, 66
See application file for complete search history.

(56) References Cited

U.S. PATENT DOCUMENTS

| | | | | |
|---|---|---|---|---|
| 4,563,592 | A * | 1/1986 | Yuhasz et al. | 307/115 |
| 4,803,380 | A | 2/1989 | Jacoby, Jr. et al. | |
| 4,833,277 | A | 5/1989 | Jacoby, Jr. et al. | |
| 4,835,343 | A * | 5/1989 | Graef et al. | 174/66 |
| 4,924,349 | A | 5/1990 | Buehler et al. | |
| 5,221,814 | A * | 6/1993 | Colbaugh et al. | 174/66 |
| 5,463,286 | A * | 10/1995 | D'Aleo et al. | 315/295 |
| 5,637,930 | A * | 6/1997 | Rowen et al. | 307/112 |
| 6,329,596 | B1 * | 12/2001 | Justiniano et al. | 174/66 |
| 7,190,125 | B2 | 3/2007 | McDonough et al. | |
| 7,506,990 | B2 * | 3/2009 | Glazner | 362/95 |
| 7,641,491 | B2 | 1/2010 | Altonen et al. | |
| 7,663,325 | B2 | 2/2010 | McDonough et al. | |
| 7,796,057 | B2 | 9/2010 | Swatsky et al. | |
| 2005/0146288 | A1 * | 7/2005 | Johnson et al. | 315/291 |
| 2007/0272532 | A1 | 11/2007 | Pessina et al. | |
| 2008/0111491 | A1 * | 5/2008 | Spira | 315/158 |
| 2008/0258644 | A1 | 10/2008 | Altonen et al. | |
| 2009/0251352 | A1 | 10/2009 | Altonen et al. | |

* cited by examiner

*Primary Examiner* — Douglas W Owens
*Assistant Examiner* — Henry Luong
(74) *Attorney, Agent, or Firm* — Mark E. Rose; Philip N. Smith; Bridget L. McDonough

(57) ABSTRACT

A load control device for controlling the power delivered from an AC power source to an electrical load is operable to be converted from being configured as an electronic switch to being configured as a dimmer switch after installation. The load control device comprises a dimmer bezel having a control actuator and an intensity adjustment actuator and a detachable switch bezel adapted to be attached to the dimmer bezel. The detachable switch bezel has an opening through which the control actuator may be actuated, and is adapted to cover the intensity adjustment actuator when the detachable switch bezel is attached to the dimmer bezel. The load control device is operable to change from a switch mode of operation to a dimmer mode of operation after the detachable switch bezel is removed from the dimmer bezel.

19 Claims, 7 Drawing Sheets

METHOD AND APPARATUS FOR CONVERTING AN ELECTRONIC SWITCH TO A DIMMER SWITCH

CROSS-REFERENCE TO RELATED APPLICATIONS

This application is a non-provisional application of commonly-assigned U.S. Provisional Application Ser. No. 61/267,483, filed Dec. 8, 2009, entitled METHOD AND APPARATUS FOR CONVERTING AN ELECTRONIC SWITCH TO A DIMMER SWITCH, the entire disclosure of which is hereby incorporated by reference.

BACKGROUND OF THE INVENTION

1. Field of the Invention

The present invention relates to control devices for controlling the amount of power delivered from an alternating-current (AC) power source to an electrical load, and more particularly, to a load control device that may be converted from being configured as an electronic switch to being configured as a dimmer switch after installation.

2. Description of the Related Art

Typical load control devices are adapted to be coupled in series between an alternating-current (AC) power source and an electrical load, such as a lighting load or a motor load, for control of the power delivered from the AC power source to the electrical load. Wall-mounted load control devices are adapted to be mounted to standard electrical wallboxes. A standard mechanical switch may be switched between a closed state (in which power is delivered to the load and the load is on) and a closed state (in which power is not delivered to the load and the load is off). An electronic switch (i.e., a digital switch) comprises a controllably conductive device (such as a relay or a bidirectional semiconductor switch, e.g., a triac), which is coupled in series between the power source and the load and is controlled to be conductive and non-conductive to toggle the electrical load on and off, respectively. A typical electronic switch comprises a microprocessor (or similar controller) for controlling the controllably conductive device and a power supply for powering the microprocessor. In addition, the electronic switch may comprise, for example, a memory, a communication circuit, and a visual indicator, e.g., a light-emitting diode (LED), which are all powered by the power supply.

A dimmer switch is operable to control the amount of power delivered from the AC power source to the electrical load, e.g., to control the intensity of a lighting load. A typical dimmer switch comprises a bidirectional semiconductor switch (such as a triac) coupled in series between the power source and the load. The semiconductor switch is controlled to be conductive and non-conductive for portions of a half-cycle of the AC power source to thus control the amount of power delivered to the load (e.g., using a phase-control dimming technique). A "smart" dimmer switch (i.e., a digital dimmer switch) comprises a microprocessor (or similar controller) for controlling the semiconductor switch and a power supply for powering the microprocessor. The smart dimmer switch may also comprise a memory, a communication circuit, and a plurality of light-emitting diodes (LEDs) for providing feedback of the intensity of the controlled lighting load.

After installation of an electronic switch, a user of the switch may desire to upgrade the electronic switch to a dimmer switch to provide for control of the specific amount of power delivered to the controlled electrical load. Thus, there exists a need for an electronic switch that may easily be converted into a dimmer switch after installation.

SUMMARY OF THE INVENTION

According to an embodiment of the present invention, a control device is operable to be converted from being configured as an electronic switch to being configured as a dimmer switch after installation. The control device is operable to control the power delivered from an AC power source to an electrical load. The control device comprises a dimmer bezel having a control actuator and an intensity adjustment actuator and a detachable switch bezel adapted to be attached to the dimmer bezel. The detachable switch bezel has an opening positioned such that the control actuator is actuated through the opening when the detachable switch bezel is attached to the dimmer bezel. The detachable switch bezel is adapted to cover the intensity adjustment actuator when the detachable switch bezel is attached to the dimmer bezel. The control device further comprises an air-gap switch actuator coupled to an air-gap switch, which is adapted to be coupled in series electrical connection between the AC power source and the electrical load for providing an actual air-gap break between the AC power source and the electrical load when the air-gap switch is open. The air-gap switch is opened when the air-gap switch actuator is pulled out from the control device. The detachable switch bezel comprises an actuator break adjacent the air-gap actuator that allows the air-gap actuator to be pulled out from the control device when the detachable switch bezel is attached to the dimmer bezel. The control device is operable to change from a switch mode of operation to a dimmer mode of operation after the detachable switch bezel is removed from the dimmer bezel.

The load control device may further comprise a controllably conductive device adapted to be coupled between the source and the load for controlling the power delivered to the load, and a controller operatively coupled to a control input of the controllably conductive device for rendering the controllably conductive device conductive and non-conductive so as to control the power delivered to the load in response to actuations of the control actuator and the intensity adjustment actuator. Alternatively, the load control device may comprise a communication circuit coupled to the controller, such that the controller is operable to transmit digital message on a communication link including commands for controlling the load in response to actuations of the control actuator and the intensity adjustment actuator. According to one embodiment of the present invention, the controller is operable to change from the switch mode of operation to the dimmer mode of operation in response to the first actuation of the intensity adjustment actuator after the detachable switch bezel is removed from the dimmer bezel. According to another embodiment of the present invention, the controller is operable to provide an advanced programming mode for changing between the switch mode of operation and the dimmer mode of operation.

In addition, the present invention provides a detachable switch bezel for use with a control device for controlling power delivered from an AC power source and an electrical load and having a dimmer bezel, a control actuator, an intensity adjustment actuator, and an air-gap switch actuator. The air-gap switch actuator is adapted to be coupled in series electrical connection between the AC power source and the electrical load and to be opened when the air-gap switch actuator is pulled out from the control device. The detachable switch bezel comprises a front surface having an opening, and four sidewalls arranged around a periphery of the front surface. The detachable switch bezel is adapted to be attached to the dimmer bezel of the control device, such that the control actuator is actuated through the opening. The detachable switch bezel further comprises a recess for receiving the intensity adjustment actuator when the switch bezel is attached to the dimmer bezel, such that the detachable switch bezel adapted to cover the intensity adjustment actuator when the detachable switch bezel is attached to the dimmer bezel. The detachable switch bezel further comprises an actuator break adapted to be located adjacent the air-gap actuator when the switch bezel is attached to the dimmer bezel. The actuator break allows the air-gap actuator to be pulled out from the control device when the detachable switch bezel is attached to the dimmer bezel.

Other features and advantages of the present invention will become apparent from the following description of the invention that refers to the accompanying drawings.

BRIEF DESCRIPTION OF THE DRAWINGS

The invention will now be described in greater detail in the following detailed description with reference to the drawings in which.

DETAILED DESCRIPTION OF THE INVENTION

Figure 1:
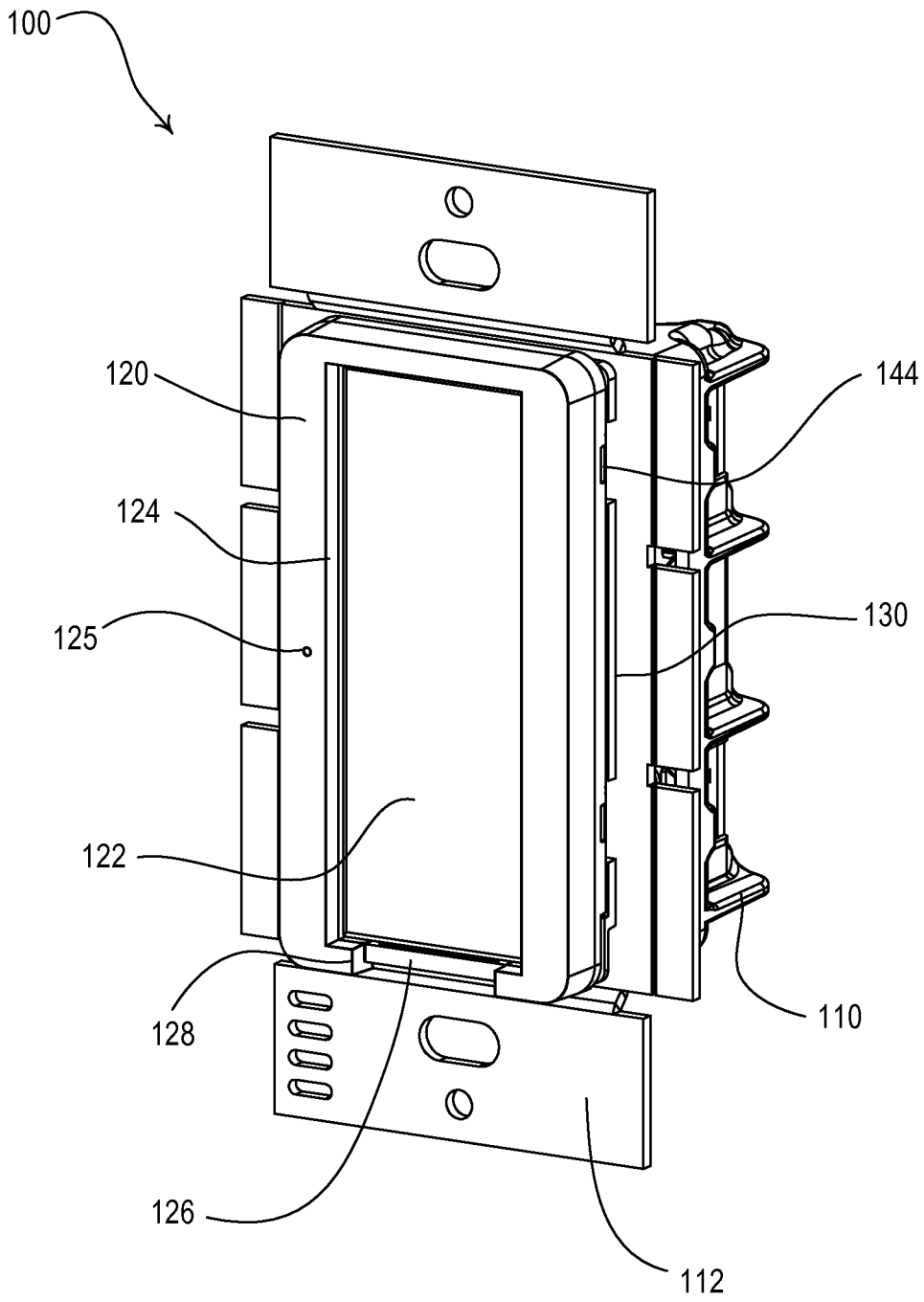
FIG. 1 is a perspective view of a load control device configured as an electronic switch according to the present invention.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

FIG. 1 is a perspective view of a load control device 100 configured as an electronic switch according to the present invention. The load control device 100 is adapted to be coupled in series electrical connection between an alternating-current (AC) power source 102 (FIG. 4) and an electrical load, such as a lighting load 104 (FIG. 4), for controlling of the amount of power delivered to the lighting load. The load control device 100 comprises an enclosure 110 for housing the electrical circuitry of the load control device, which will be described in greater detail below with reference to FIG. 4. The load control device 100 further comprises a mounting yoke 112 for mounting the load control device in a standard electrical wallbox.

Figure 2:
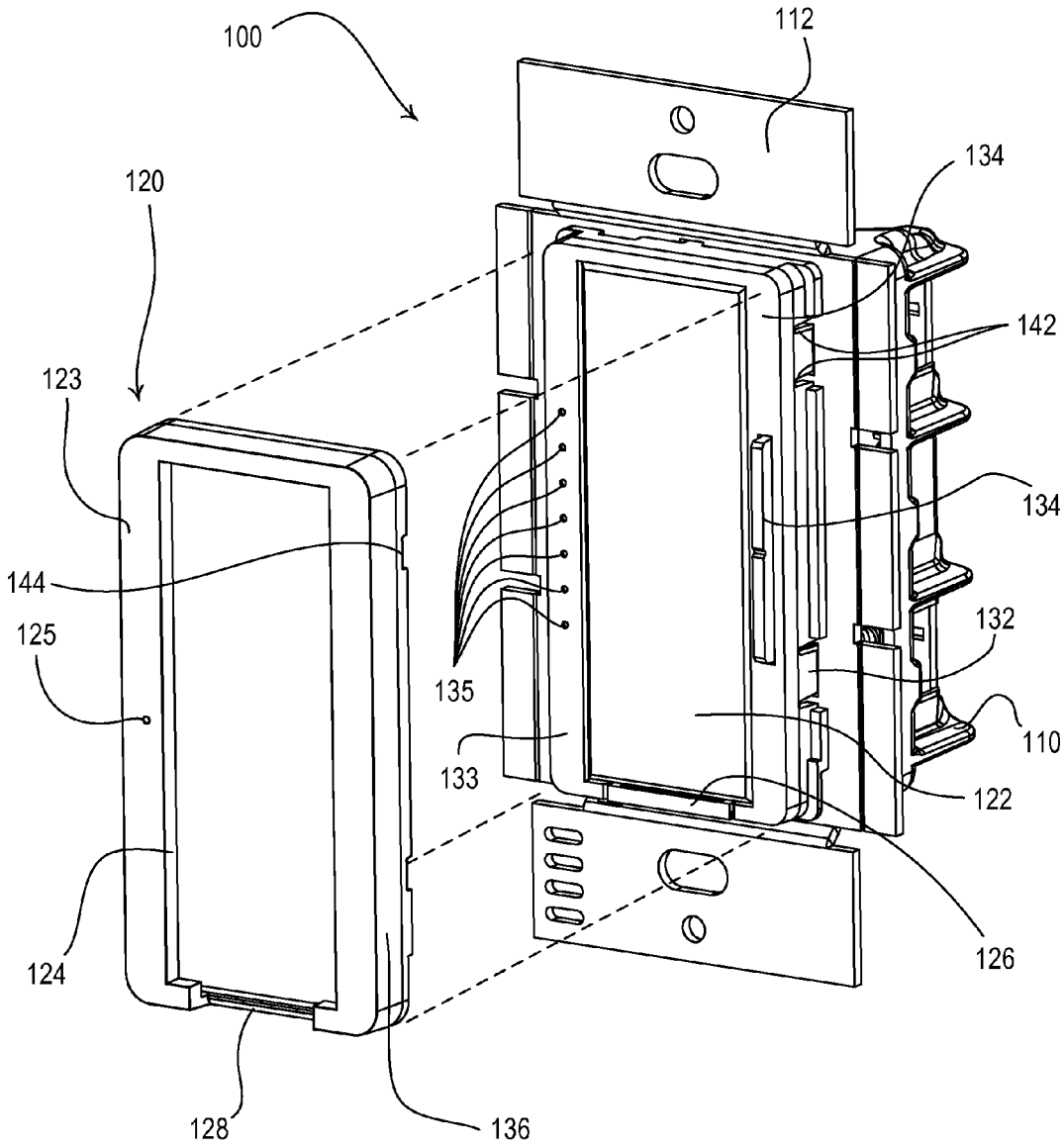
FIG. 2 is a perspective view of the load control device of FIG. 1 showing how a detachable switch bezel may be removed in order to configure the load control device as a dimmer switch according to the present invention.

FIG. 2 is a perspective view of the load control device 100 showing how a detachable switch bezel 120 may be removed from the load control device in order to configure the load control device as a dimmer switch according to the present invention. When the switch bezel 120 is connected to the load control device 100, the load control device is configured as an electronic switch (as shown in FIG. 1). At this time, a control actuator 122 (i.e., a toggle button or a tap switch) is provided through an opening 124 in a front surface 123 of the switch bezel 120, and the load control device 100 may be configured to operate in a switch mode, such that the load control device toggles (i.e., turns off and on) the lighting load 104 in response to actuations of the control actuator 122. The switch bezel 120 comprises a single visual indicator 125 for providing feedback of whether the lighting load is on or off (i.e., the visual indicator is illuminated when the lighting load is on and not illuminated when the lighting load is off). Alternatively, the visual indicator 125 may be illuminated dimly to provide a nightlight feature when the lighting load 104 is off. The visual indicator 125 may be illuminated by a light source (such as a light-emitting diode) inside the load control device 100.

The load control device 100 also comprises an air-gap switch actuator 126, which is provided in an actuator break 128 of the switch bezel 120 (i.e., the actuator break is adjacent the air-gap actuator). Pulling the air-gap switch actuator 126 out from the load control device 100 actuates an air-gap switch 205 (FIG. 4) inside the load control device for providing a true air-gap break between the AC power source 102 and the lighting load 104. The actuator break 128 allows the air-gap actuator 126 to be pulled out from the load control device 100 when the detachable switch bezel 120 is attached to the load control device.

When the detachable switch bezel 120 is removed from the load control device 100 (as shown in FIG. 2), the load control device may be re-configured to operate as a dimmer switch such that the load control device is operable to adjust the amount of power delivered to the lighting load 104 (as will be described in greater detail below with reference to FIGS. 5 and 6). When the detachable switch bezel 120 is removed, a dimmer bezel 130 is exposed to the user. The dimmer bezel 130 is connected to the yoke 112 of the load control device 100 via attachment tabs 132. When configured to operate as a dimmer switch, the load control device 100 is operable to control of the amount of power delivered to the lighting load 104, so as to control a present intensity L of the lighting load between a minimum intensity $L_{MIN}$ (e.g., approximately 1%) and a maximum intensity $L_{MAX}$ (e.g., approximately 100%).

The dimmer bezel 130 comprises an intensity adjustment actuator 134 (e.g., a rocker switch), which extends from a front surface 133 of the dimmer bezel 130 as shown in FIG. 2. Alternatively, the intensity adjustment actuator 134 could be flush with the front surface of the dimmer bezel 130. When the detachable switch bezel 120 is not attached to the load control device 100, the load control device 100 may be configured to operate in a dimmer mode, such that the load control device is operable to control the amount of power delivered to the lighting load 104 (and thus the intensity of the lighting load) in response to actuations of the intensity adjustment actuator 134. Specifically, actuations of an upper portion or a lower portion of the intensity adjustment actuator 134 respectively increase or decrease the amount of power delivered to the lighting load 104 and thus increase or decrease the intensity of the lighting load 104.

The dimmer bezel 130 further comprises a plurality of visual indicators 135, which are illuminated to provide feedback of the present intensity of the lighting load 104. For example, the load control device 100 may illuminate one of the plurality of visual indicators 135 that is representative of the present intensity L of the lighting load 104. The visual indicators 135 may be illuminated by a plurality of respective light-emitting diodes (LEDs) 215 (FIG. 4) inside the load control device 100. The load control device 100 may comprise a light pipe (not shown) for conducting the light from the LEDs 215 inside the load control device to the visual indicators 135 on the front surface 133 of the dimmer bezel 130. The single visual indicator 125 of the detachable switch bezel 120 is positioned on the switch bezel, such that the single visual indicator is arranged immediately adjacent one of the visual indicators 135 of the dimmer bezel 130 (e.g., the middle one of the visual indicators 135) when the detachable switch bezel is attached to the dimmer bezel. Accordingly, the single visual indicator 125 of the detachable switch bezel 120 may be illuminated by one of the LEDs 215 when the detachable switch bezel is attached to the dimmer bezel.

When the detachable switch bezel 120 is removed from the load control device 100, actuations of the control actuator 122 still cause the load control device 100 to toggle the lighting load 104 on and off. The load control device 100 may be programmed with a lighting preset intensity (i.e., a "favorite" intensity level), such that the dimmer switch is operable to control the intensity of the lighting load 104 to the preset intensity when the lighting load is turned on by an actuation of the toggle actuator 122. An example of a smart dimmer switch is described in greater detail in U.S. Pat. No. 5,248,919, issued Sep. 29, 1993, entitled LIGHTING CONTROL DEVICE, the entire disclosure of which is hereby incorporated by reference.

Figure 3:
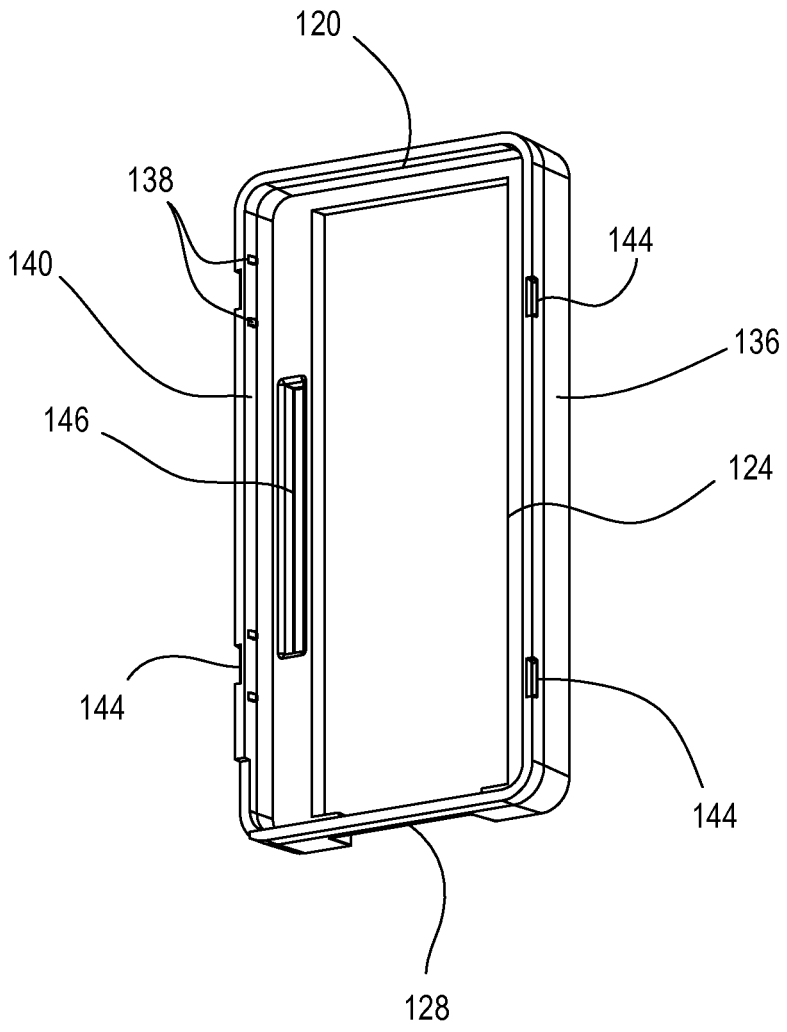
FIG. 3 is a rear perspective view of the detachable switch bezel of FIG. 2.

FIG. 3 is a rear perspective view of the detachable switch bezel 120. The switch bezel 120 comprises four sidewalls 136 arranged around the periphery of the front surface 123 and four pairs of snaps 138 that are located on interior surfaces 140 of the sidewalls. The snaps 138 are received in openings 142 (FIG. 2) formed between the attachment tabs 132 and the body of the dimmer bezel 130 when the switch bezel is attached to the dimmer bezel, and operate to hold the switch bezel on the dimmer bezel. The switch bezel 120 also comprises notches 144 that each may receive the end of a tool (e.g., a flat-headed screwdriver) to aid in removal of the switch bezel 120 from the dimmer bezel 130. Further, the switch bezel 120 comprises a recess 146 for receiving and covering the intensity adjustment actuator 134 when the switch bezel 120 is attached to the dimmer bezel 130.

After removal of the detachable switch bezel 120, the load control device 100 may be operable to change from the switch mode of operation to the dimmer mode in response to the first actuation of the intensity adjustment actuator 134. Alternatively, the load control device 100 may be operable to provide an advanced programming mode (APM) for changing the load control device between the switch mode and the dimmer mode as will be described in greater detail below with reference to FIG. 7.

Figure 4:
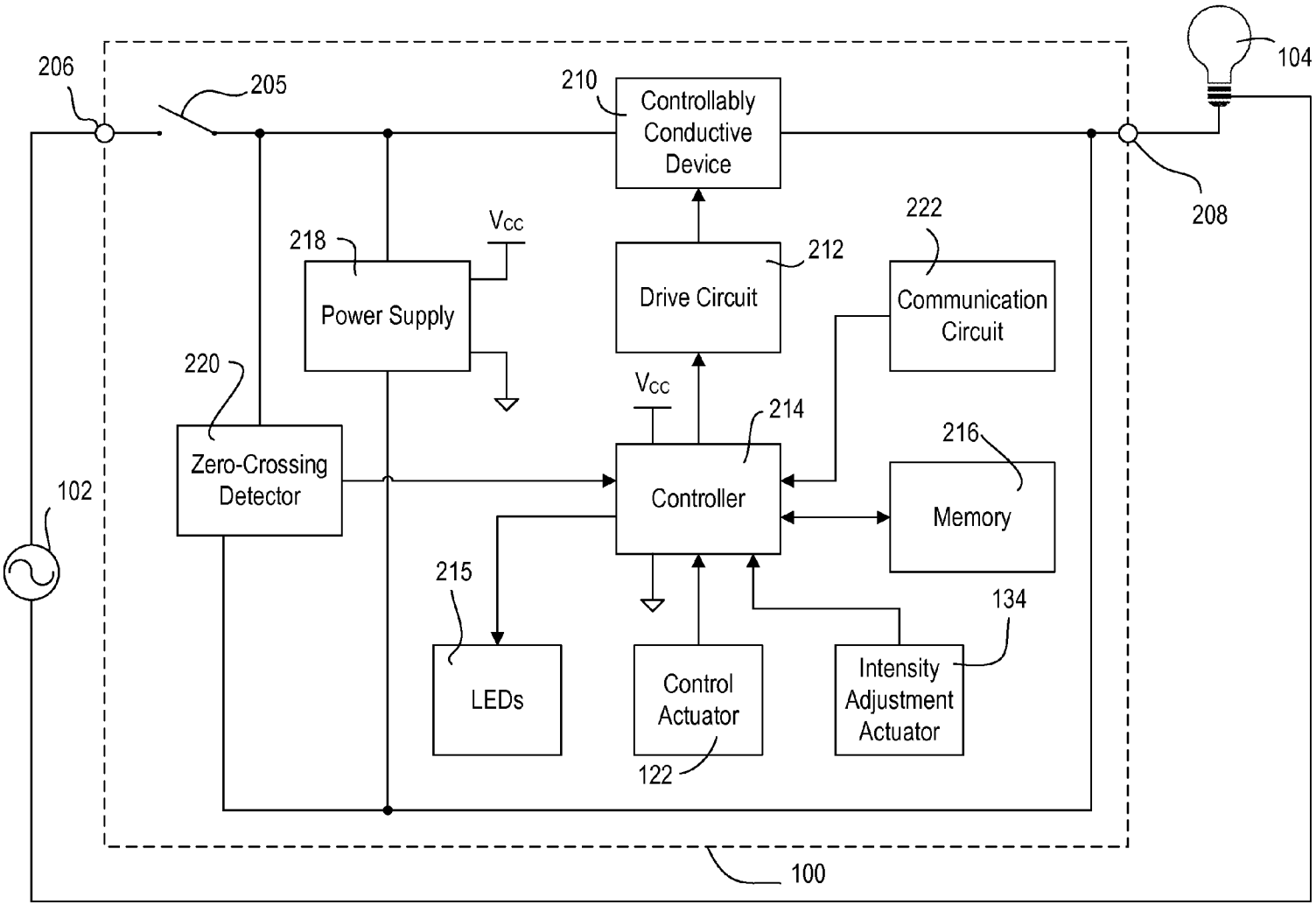
FIG. 4 is a simplified schematic diagram of the load control device of FIG. 1.

FIG. 4 is a simplified block diagram of the load control device 100. The load control device 100 comprises a hot terminal 206 adapted to be connected to the AC power source 102 and load terminal 208 (i.e., a switched-hot/dimmed-hot terminal) adapted to be coupled to the lighting load 104. The load control device 100 comprises a controllably conductive device 210 coupled in series electrical connection between the AC power source 102 and the lighting load 104 for control of the power delivered to the lighting load. The controllably conductive device 210 may comprise any suitable type of bidirectional semiconductor switch, such as, for example, a triac, a field-effect transistor (FET) in a rectifier bridge, or two FETs in anti-series connection. The controllably conductive device 210 includes a control input coupled to a drive circuit 212. The input provided to the control input will render the controllably conductive device 210 conductive or non-conductive, which in turn controls the power supplied to the lighting load 104.

The drive circuit 212 provides control inputs to the controllably conductive device 210 in response to command signals from a controller 214. The controller 214 may be implemented as a microcontroller, a microprocessor, a programmable logic device (PLD), an application specific integrated circuit (ASIC), a field-programmable gate array (FPGA), or any suitable processing device. In the switch mode, the controller 214 controls the controllably conductive device so as to generate a switched-hot voltage at the load terminal 208. When operating in the dimmer mode, the controller 214 controls the controllably conductive device using a standard phase-control technique so as to generate a dimmed-hot voltage at the load terminal 208. The controller 214 receives inputs from the control actuator 122 and the intensity adjustment actuator 134 and controls the LEDs 215 for illuminating either the visual indicator 125 of the detachable switch bezel 120 or the linear array of visual indicators 135 of the dimmer bezel 130. The controller 214 is also coupled to a memory 216 for storage of the mode of operation (i.e., the switch mode or the dimmer mode) and the preset intensity of lighting load 104. A power supply 218 generates a direct-current (DC) voltage $V_{CC}$ for powering the controller 214, the memory 216, and other low-voltage circuitry of the load control device 100.

A zero-crossing detector 220 determines the zero-crossings of the input AC waveform from the AC power supply 102. A zero-crossing is defined as the time at which the AC supply voltage transitions from positive to negative polarity, or from negative to positive polarity, at the beginning of each half-cycle. In the dimmer mode, the controller 214 provides the control inputs to the drive circuit 212 to operate the controllably conductive device 210 (i.e., to provide voltage from the AC power supply 102 to the lighting load 104) at predetermined times relative to the zero-crossing points of the AC waveform using the phase-control technique.

The load control device may further comprise a communication circuit 222 for transmitting and receiving digital messages via a communication link, such as a wired communication link or a wireless communication link, e.g., a radio-frequency (RF) communication link or an infrared (IR) communication link. The controller 214 is operable to control the controllably conductive device 210 in response to the digital messages received via the communication circuit 222. An example of RF load control systems are described in greater detail in U.S. Pat. No. 7,573,208, issued Aug. 11, 2009, entitled METHOD OF PROGRAMMING A LIGHTING PRESET FROM A RADIO-FREQUENCY REMOTE CONTROL, and U.S. patent application Ser. No. 12/033,223, filed Feb. 19, 2008, entitled COMMUNICATION PROTOCOL FOR A RADIO-FREQUENCY LOAD CONTROL SYSTEM, the entire disclosures of which are hereby incorporated by reference. An example of an IR load control system is described in greater detail in U.S. Pat. No. 6,545,434, issued Apr. 8, 2003, entitled MULTI-SCENE PRESET LIGHTING CONTROLLER, the entire disclosure of which is hereby incorporated by reference.

Alternatively, the load control device 100 may simply operate as a remote control device in a load control system that includes a separate load control device (not shown), which is coupled between the AC power source 102 and the lighting load 104 for controlling the power delivered to the load. When operating as a remote control device, the load control device 100 simply transmits digital messages including commands to control the power delivered to the load to the separate load control device, which in turn controls the power delivered to the lighting load 104. Examples of load control systems including remote control devices and separate load control devices are described in greater detail in commonly-assigned U.S. Pat. No. 7,423,413, issued Sep. 9, 2008, and entitled POWER SUPPLY FOR A LOAD CONTROL DEVICE, and U.S. patent application Ser. No. 11/447,431, filed Jun. 6, 2006, entitled SYSTEM FOR CONTROL OF LIGHTS AND MOTORS, the entire disclosures of which are hereby incorporated by reference.

As previously mentioned, the load control device 100 of the present invention may be converted from an electronic switch to a dimmer switch after installation. Specifically, the detachable switch bezel 120 may first be removed from the load control device 100 and then the intensity adjustment actuator 134 may be actuated to change the load control device to the dimmer mode. Alternatively, the load control device 100 may be changed between the switch mode and the dimmer mode via an advanced programming mode.

Figure 5:
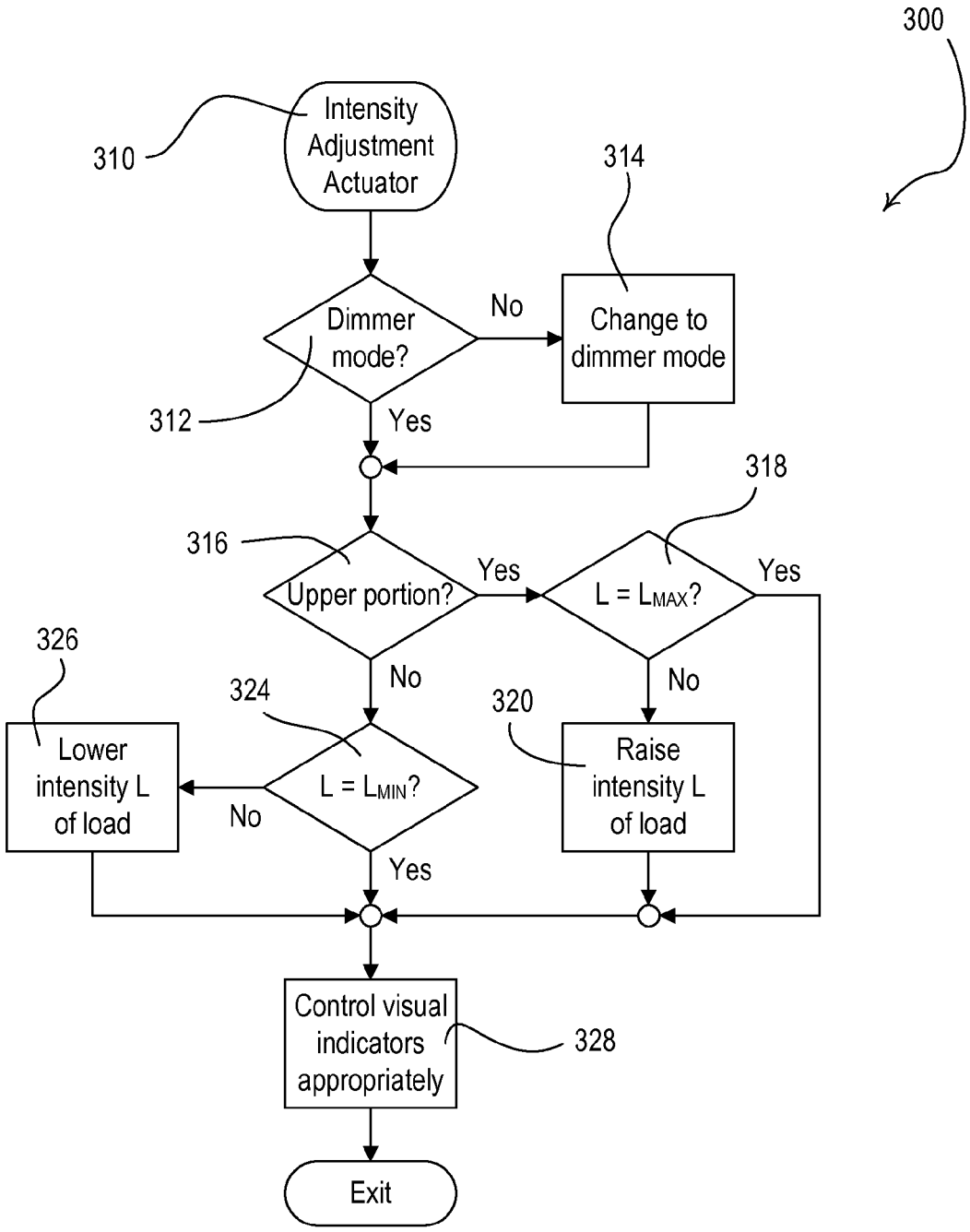
FIG. 5 is a simplified flowchart of an intensity adjustment actuator procedure executed by a controller of the load control device of FIG. 1 when an intensity adjustment actuator is actuated.

FIG. 5 is a simplified flowchart of an intensity adjustment actuator procedure 300 executed by the controller 214 when the intensity adjustment actuator 134 is actuated at step 310. If the load control device 100 is not presently in the dimmer mode (as stored in the memory 216) at step 312, the controller 214 changes to the dimmer mode at step 314. If the load control device 100 is presently in the dimmer mode at step 312 or after the controller 214 changes to the dimmer mode at step 314, the controller then appropriately controls the controllably conductive device 210 to control the amount of power being delivered to the lighting load 104. If the upper portion of the intensity adjustment actuator 134 has been actuated at step 316 and the present intensity L of the lighting load 104 is not equal to the maximum intensity $L_{MAX}$ (i.e., approximately 100%) at step 318, the controller 214 increases the present intensity L by a predetermined amount (e.g., approximately 1%) at step 320. If the upper portion of the intensity adjustment actuator 134 has not been actuated at step 316 (i.e., the lower portion of the intensity adjustment actuator has been actuated) and the present intensity L of the lighting load 104 is not equal to the minimum intensity $L_{MIN}$ (i.e., approximately 1%) at step 322, the controller 214 decreases the present intensity L by a predetermined amount (e.g., approximately 1%) at step 324. Next, the controller 214 controls the visual indicators 135 appropriately at step 328 (e.g., to illuminate one of the visual indicators that is representative of the present intensity L of the lighting load 104), before the intensity adjustment actuator procedure 300 exits.

Figure 6:
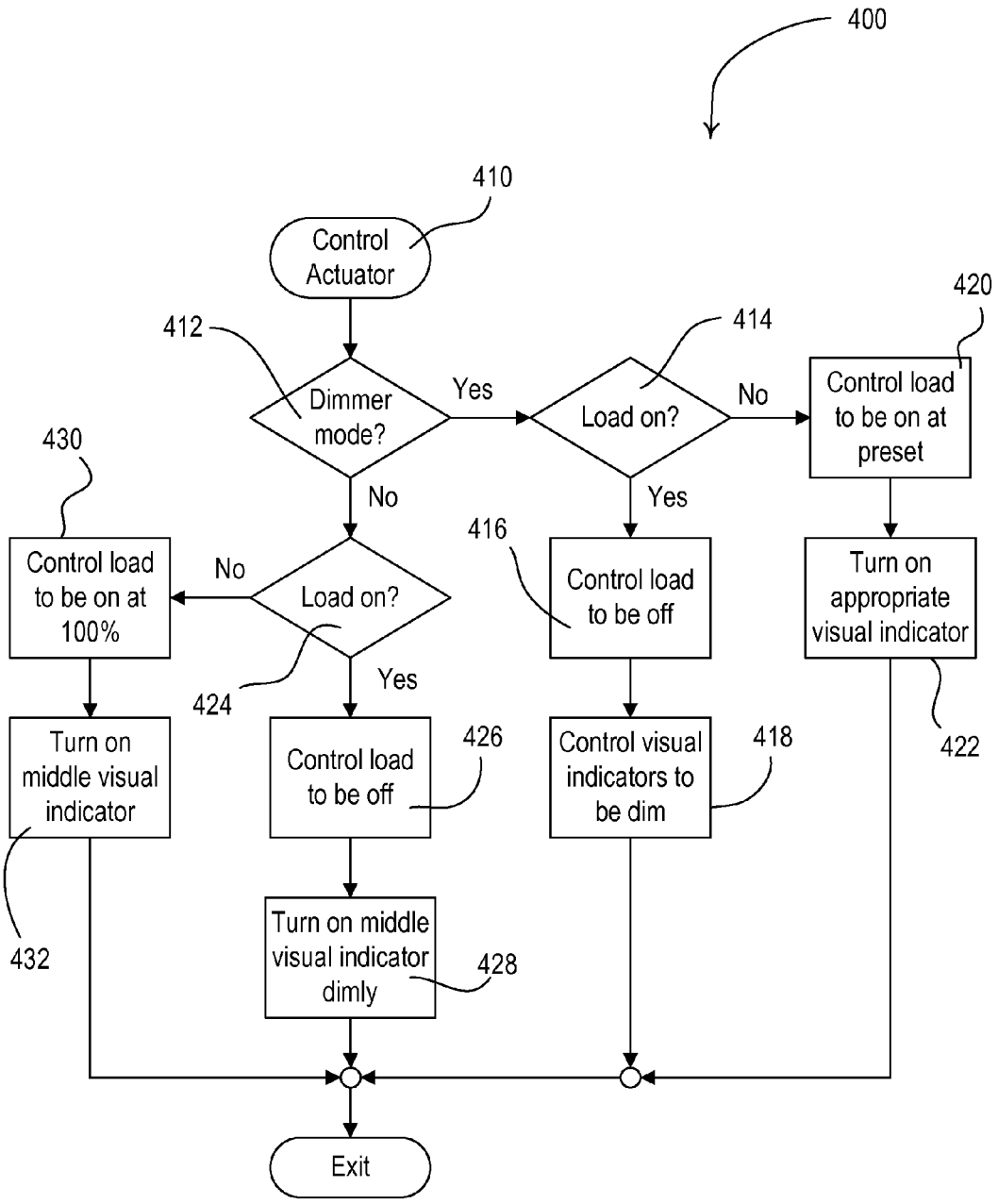
FIG. 6 is a simplified flowchart of a control actuator procedure executed by the controller of the load control device of FIG. 1 when a control actuator is actuated.

FIG. 6 is a simplified flowchart of a control actuator procedure 400 executed by the controller 214 when the control actuator 122 is actuated at step 410. If the load control device 100 is presently in the dimmer mode at step 412 and the lighting load 104 is presently on at step 414, the controller 214 controls the lighting load to be off at step 416. At step 418, the controller 214 controls the visual indicators 135 to be illuminated dimly (to provide the nightlight feature) and controls one of the visual indicators that is representative of the preset intensity $L_{PRE}$ to be illuminated dimly, but to a greater intensity than the other visual indicators. If the lighting load 104 is off at step 414, the controller 214 controls the lighting load to be on at the preset intensity $L_{PRE}$ at step 420, and turns on (i.e., brightly illuminates) one of the visual indicators 135 that is representative of the preset intensity at step 422, before the control actuator procedure 400 exits. If the load control device 100 is presently in the switch mode at step 412 and the lighting load 104 is presently on at step 424, the controller 214 controls the lighting load to be off at step 426 and turns on the middle one of the visual indicators 135 dimly (to provide the nightlight feature) at step 428. If the lighting load 104 is off at step 426, the controller 214 controls the lighting load to be on at the maximum intensity $L_{MAX}$ at step 430 and turns on (i.e., brightly illuminates) the middle one of the visual indicators 135 at step 432, before the control actuator procedure 400 exits. In the dimmer mode, additional actuations of the control actuator 122 (such as, double-tapping or pressing and holding the control actuator) may provide additional functionality as described in above-referenced U.S. Pat. No. 5,248,919.

Figure 7:
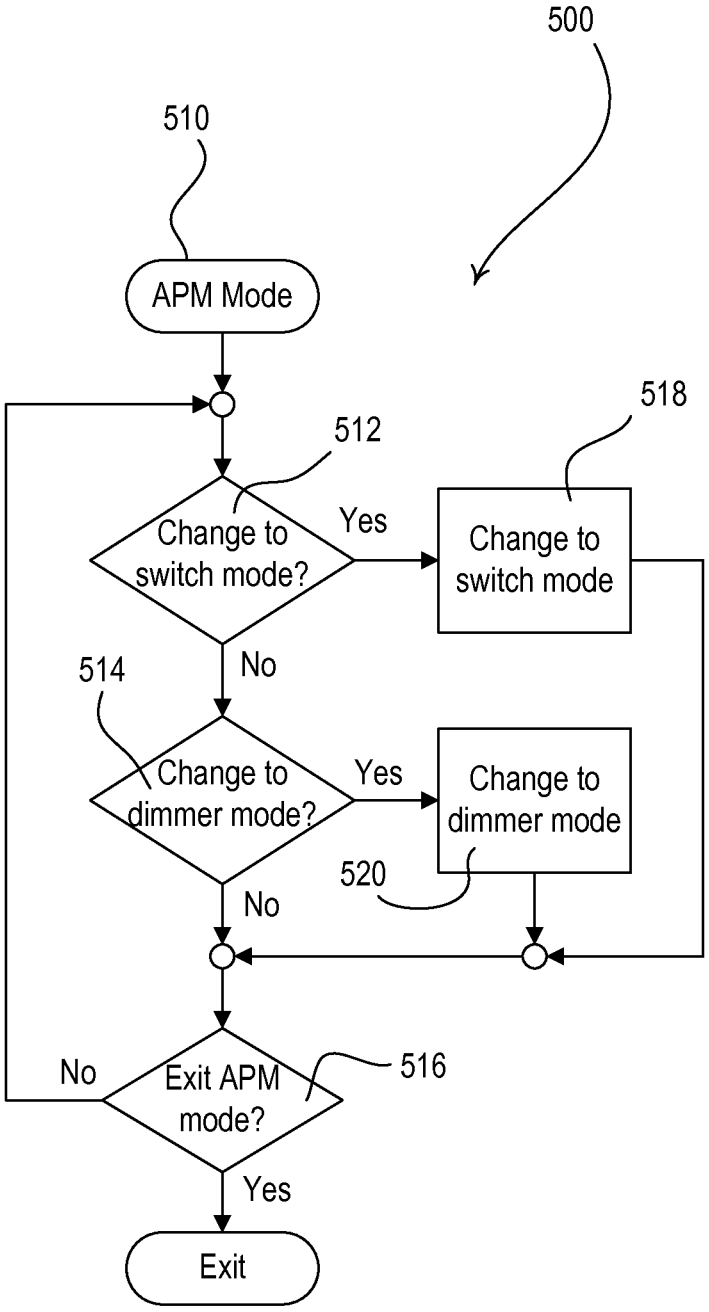
FIG. 7 is a simplified flowchart of an advanced programming mode procedure executed by the controller of the load control device of FIG. 1 for changing the load control device between a switch mode and a dimmer mode.

FIG. 7 is a simplified flowchart of an advanced programming mode procedure 500 executed by the controller 214 in order to change the load control device 100 between the switch mode and the dimmer mode according to the present invention. The controller 214 executes the advanced programming mode procedure 500 in response to receiving a command to enter the advanced programming mode (APM) at step 510. For example, the controller 214 may be adapted to enter the advanced programming mode in response to the user pulling the air-gap switch actuator 126 out (i.e., away from the load control device 100) to open the air-gap switch 205, actuating the control actuator 122 while the air-gap switch 205 is open, pushing the air-gap switch actuator back in to close the air-gap switch while the control actuator is still being actuated, and holding the control actuator for at least a prescribed period of time after the air-gap switch is closed After receiving the command to enter the advanced programming mode at step 510, the controller 214 waits to receive a command to change to the switch mode at step 512, a command to change to the dimmer mode at step 514, or a command to exit the advanced programming mode at step 516. If the controller 214 receives a command to change to the switch mode at step 512, the controller changes to the switch mode at step 518. If the controller 214 receives a command to change to the dimmer mode at step 514, the controller changes to the dimmer mode at step 520. If the controller 214 receives a command to exit the advanced programming mode at step 516, the advanced programmed mode procedure 500 simply exits. An example of an advanced programming mode for a dimmer switch is described in greater detail in U.S. Pat. No. 7,190,125, issued Mar. 13, 2007, entitled PROGRAMMABLE WALLBOX DIMMER, the entire disclosure of which is hereby incorporated by reference.

While the present invention has been described with reference to the load control device 100 for controlling the amount of power delivered to a connected lighting load, the concepts of the present invention could be applied to load control systems comprising other types of load control devices, such as, for example, a fan-speed control for controlling a fan motor, an electronic dimming ballast for a fluorescent load, and a driver for a light-emitting diode (LED) light source. Further, the concepts of the present invention could be used to control other types of electrical loads, such as, for example, fan motors or motorized window treatments.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A control device for controlling power delivered from an AC power source to an electrical load, the control device comprising:

a dimmer bezel having a control actuator and an intensity adjustment actuator;

a detachable switch bezel adapted to be attached to the dimmer bezel, the detachable switch bezel having an opening such that the control actuator is actuated through the opening when the detachable switch bezel is attached to the dimmer bezel, the detachable switch bezel adapted to cover the intensity adjustment actuator when the detachable switch bezel is attached to the dimmer bezel;

an air-gap switch adapted to be coupled in series electrical connection between the AC power source and the electrical load for providing an actual air-gap break between the AC power source and the electrical load when the air-gap switch is open; and an air-gap switch actuator coupled to the air-gap switch, such that the air-gap switch is opened when the air-gap switch actuator is pulled out from the control device, the detachable switch bezel comprising an actuator break adjacent the air-gap actuator that allows the air-gap actuator to be pulled out from the control device when the detachable switch bezel is attached to the dimmer bezel;

wherein the control device is operable to change from a switch mode of operation to a dimmer mode of operation after the detachable switch bezel is removed from the dimmer bezel.

2. The control device of claim 1, further comprising:

a controller responsive to the control actuator and the intensity adjustment actuator for controlling the power delivered to the load, and for changing the control device from the switch mode of operation to the dimmer mode of operation after the detachable switch bezel is removed from the dimmer bezel.

3. The control device of claim 2, wherein the dimmer bezel further comprises a linear array of visual indicators operable to be illuminated to provide a representation of an amount of power being delivered to the load when the controller is operating in the dimmer mode.

4. The control device of claim 3, wherein the detachable switch bezel comprises a single visual indicator operable to be illuminated when the controller is operating in the switch mode and when the load is on, the single visual indicator positioned on the detachable switch bezel such that the visual indicator is arranged immediately adjacent one of the visual indicators of the dimmer bezel when the detachable switch bezel is attached to the dimmer bezel.

5. The control device of claim 4, wherein the single visual indicator is arranged immediately adjacent a middle one of the visual indicators of the dimmer bezel when the detachable switch bezel is attached to the dimmer bezel.

6. The control device of claim 5, wherein the single visual indicator is illuminated dimly when the controller is operating in the switch mode and the load is off.

7. The control device of claim 2, wherein the controller is operable to turn the load on and off in response to actuations of the control actuator when operating in the switch mode.

8. The control device of claim 7, wherein the controller is operable to turn the load on and off in response to actuations of the control actuator, and to adjust an amount of power delivered to the load in response to actuations of the intensity adjustment actuator when operating in the dimmer mode.

9. The control device of claim 8, wherein the load comprises a lighting load and the controller is operable to turn the lighting load on to a preset intensity in response to actuations of the control actuator when the controller is operating in the dimmer mode.

10. The control device of claim 2, further comprising:

a communication circuit operable to transmit digital message on a communication link, the controller operatively coupled to the communication circuit for transmitting digital messages including commands for controlling the load in response to actuations of the control actuator and the intensity adjustment actuator.

11. The control device of claim 2, further comprising:

a controllably conductive device adapted to be coupled between the source and the load for controlling the power delivered to the load;

wherein the controller is operatively coupled to a control input of the controllably conductive device for rendering the controllably conductive device conductive and non-conductive so as to control the power delivered to the load in response to actuations of the control actuator and the intensity adjustment actuator.

12. The control device of claim 2, wherein the controller is operable to change from the switch mode of operation to the dimmer mode of operation in response to a first actuation of the intensity adjustment actuator after the detachable switch bezel is removed from the dimmer bezel.

13. The control device of claim 2, wherein the controller is operable to provide an advanced programming mode for changing between the switch mode of operation and the dimmer mode of operation.

14. The control device of claim 1, wherein the detachable switch bezel comprises sidewalls and a plurality of snaps located on interior surfaces of the sidewalls, the snaps adapted to be received in openings of the dimmer bezel when the detachable switch bezel is attached to the dimmer bezel.

15. The control device of claim 14, wherein the detachable switch bezel comprises at least one notch adapted to receive a tool to aid in removal of the switch bezel from the dimmer bezel.

16. The control device of claim 14, wherein the intensity adjustment actuator extends from a front surface of the dimmer bezel, and the detachable switch bezel comprises a recess for receiving the intensity adjustment actuator when the switch bezel is attached to the dimmer bezel.

17. A detachable switch bezel for use with a control device for controlling power delivered from an AC power source and an electrical load, the control device comprising a dimmer bezel having a control actuator, an intensity adjustment actuator, and an air-gap switch actuator coupled to an air-gap switch that is adapted to be coupled in series electrical connection between the AC power source and the electrical load and to be opened when the air-gap switch actuator is pulled out from the control device, the detachable switch bezel comprising:

a front surface having an opening, the detachable switch bezel adapted to be attached to the dimmer bezel of the control device, such that the control actuator is actuated through the opening;

four sidewalls arranged around a periphery of the front surface;

a recess for receiving the intensity adjustment actuator when the switch bezel is attached to the dimmer bezel, such that the detachable switch bezel adapted to cover the intensity adjustment actuator when the detachable switch bezel is attached to the dimmer bezel; and an actuator break adapted to be located adjacent the air-gap actuator when the switch bezel is attached to the dimmer bezel, the actuator break allowing the air-gap actuator to be pulled out from the control device when the detachable switch bezel is attached to the dimmer bezel.

18. The detachable switch bezel of claim 17, further comprising:

a plurality of snaps located on interior surfaces of the sidewalls, the snaps adapted to be received in openings of the dimmer bezel when the detachable switch bezel is attached to the dimmer bezel.

19. The detachable switch bezel of claim 17, further comprising:

at least one notch adapted to receive a tool to aid in removal of the switch bezel from the dimmer bezel.

* * * * *